US005634421A

United States Patent [19]

Velarde

[11] Patent Number: 5,634,421

[45] Date of Patent: Jun. 3, 1997

[54] WATERCRAFT MOORING APPARATUS

[75] Inventor: Carlo Velarde, Sanibel, Fla.

[73] Assignee: Pelican Made Products, S.V. Inc., Sanibel, Fla.

[21] Appl. No.: 546,659

[22] Filed: Oct. 23, 1995

[51] Int. Cl.[6] ..... B63B 21/00

[52] U.S. Cl. ..... 114/230; 114/221 R

[58] Field of Search ..... 114/221 R, 230, 114/293, 219

[56] References Cited

U.S. PATENT DOCUMENTS 3,863,591 2/1975 Wild ..... 114/230

5,398,634 3/1995 Eagan ..... 114/230

*Primary Examiner*—Stephen Avila

*Attorney, Agent, or Firm*—William E. Noonan

[57] ABSTRACT

A watercraft mooring apparatus is disclosed. The apparatus includes an elongate spacing device having a generally tubular element with an interior channel formed therethrough. There are a pair of resilient fender components attached to respective ends of the tubular element. Each fender component has an opening that communicates with the interior channel. A flexible line extends through and outside of the spacing device. The line has a first end portion that releasably engages a first vessel and a second end portion that releasably engages either a dock or a second vessel.

19 Claims, 4 Drawing Sheets

FIG. 8A
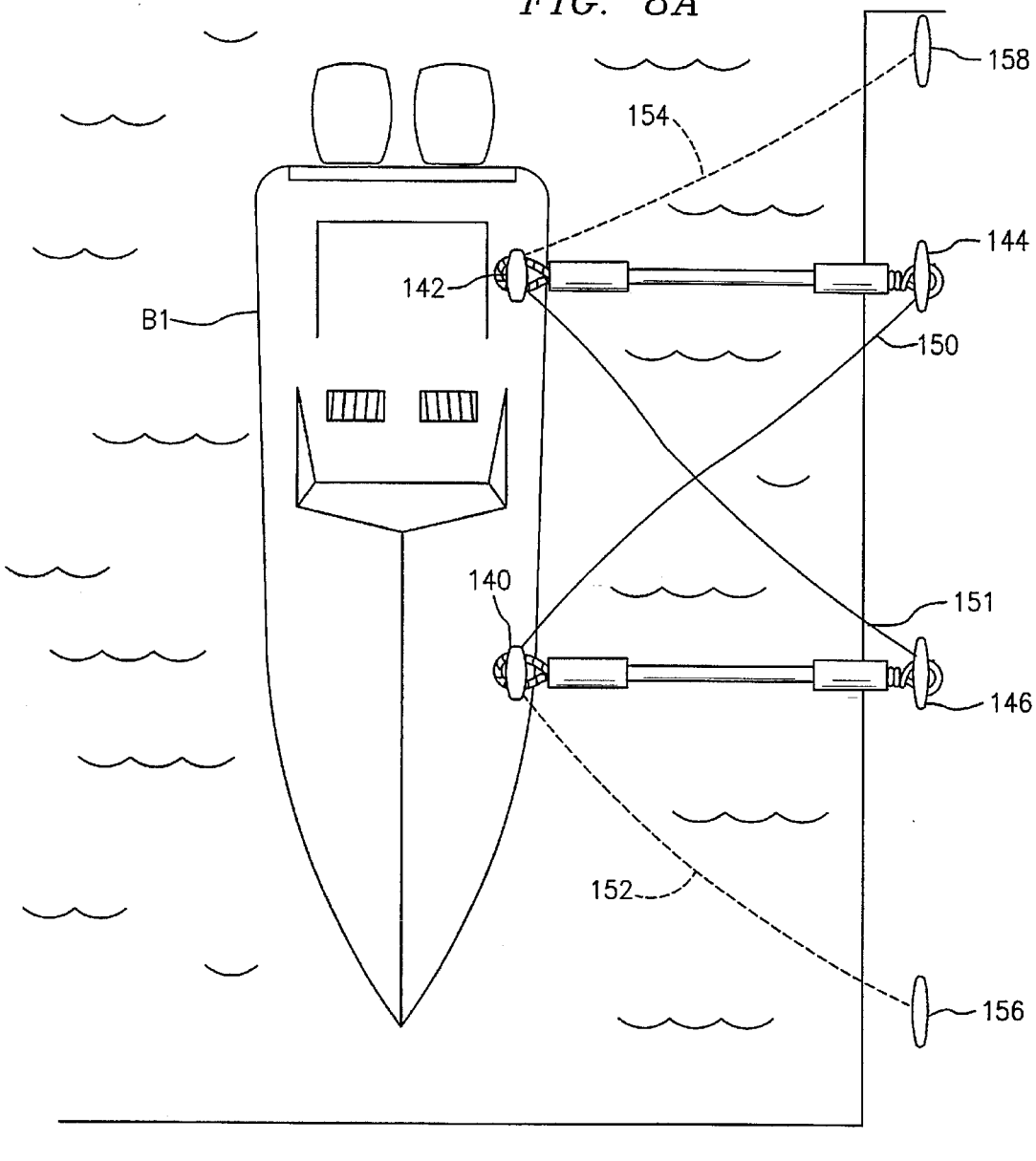
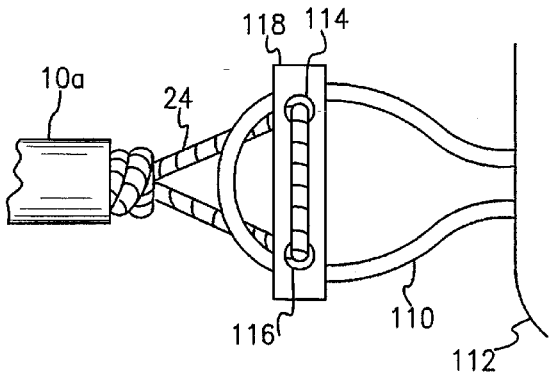
FIG. 10

WATERCRAFT MOORING APPARATUS

FIELD OF THE INVENTION

This invention relates to a watercraft mooring apparatus and, more particularly, to an apparatus that effectively secures a boat to either a dock or a second vessel while spacing the boat safely away from the dock or other vessel so that damaging collisions are prevented.

BACKGROUND OF THE INVENTION

Traditionally, boats and other watercraft have been moored to a dock by standard marine dock lines. Unfortunately such lines do not prevent damaging collisions between the boat and the dock. Storms, tidal changes, boat wakes and other sources of rough seas can push the moored vessel forcefully against the dock. This is apt to cause serious and expensive damage to the dock and/or the boat. Similar damage often results when two or more boats, rafts or other watercraft are joined together, such as by mooring whips. To date, no known devices have effectively addressed this problem. Standard marine rope and mooring whips do not safely cushion the moored vessel against damaging collisions with the dock or adjacent watercraft, particularly when the moored vessel is tossed about by rough seas.

SUMMARY OF INVENTION

It is therefore an object of the present invention to provide a watercraft mooring apparatus that effectively secures a boat or other watercraft to either a dock or another vessel and, which prevents the moored watercraft from colliding with the dock or other vessel.

It is a further object of this invention to provide a mooring apparatus that reduces the need for costly repairs to boats and docks.

It is a further object of this invention to provide a mooring apparatus that cushions and protects watercraft and docks against collisions and damage caused by mild storms, bad weather, tidal changes and other sources of rough seas.

It is a further object of this invention to provide a watercraft mooring apparatus that employs an extremely strong and durable construction.

It is a further object of this invention to provide a mooring apparatus that may be used effectively with various types of boats, rafts and other watercraft.

It is a further object of this invention to provide a mooring apparatus that is completely portable and conveniently deployed and removed so that watercraft access and departure are facilitated.

It is a further object of this invention to provide a mooring apparatus that is particularly designed for marinas and boaters with limited docking space.

This invention features a watercraft mooring apparatus that includes an elongate spacing device having a generally tubular element with an interior channel formed therethrough. A pair of resilient fender components are attached to respective ends of the tubular element. The fender components have respective openings formed therethrough. Each opening is in communication with the interior channel of the tubular element. A flexible line extends through the interior channel and the openings and outside of the spacing device. The line has a first end portion, which includes first means for releasably engaging a first vessel. An opposite second end portion includes second means for releasably engaging one of a second vessel and a dock such that the first vessel is selectively moored to one of the second vessel and the dock.

In a preferred embodiment, at least one end of the tubular element receives a respective, generally annular plug that reinforces that end. Each fender component is typically more resilient than the tubular element. The ends of the tubular element may be received in respective openings of the fender components. Each fender component may include a first section that overlaps and is in close tolerance interengagement with the tubular element and a second section that abuts and extends from a respective end of the tubular element. The opening may include a first, relatively wide portion that extends through the first section of the fender component and accommodates the tubular element. A second, relatively narrow portion of the opening is communicably connected to the first portion and extends through the second section of the fender component. Each fender component may comprise a solid structure surrounding the opening. Alternatively, each fender component may include inner and outer walls and a hollow space formed between the walls.

The first means for releasably engaging preferably includes a loop formed proximate the first end of the line. The second means for releasably engaging may include a line segment proximate the second end of the line. The line segment is selectively tied to one of the second vessel and the dock.

DETAILED DESCRIPTION OF PREFERRED EMBODIMENTS

Other objects, features and advantages will occur from the following description of preferred embodiments and the accompanying drawings, in which:

FIG. 8A is a plan view of a boat secured to a dock by a pair of the mooring apparatuses in conjunction with alternative spring line connections.

FIG. 10 is a plan view of a looped rope and an attached clip, which are used to secure the mooring apparatus to the eyelet of a personal watercraft.

Figure 1:
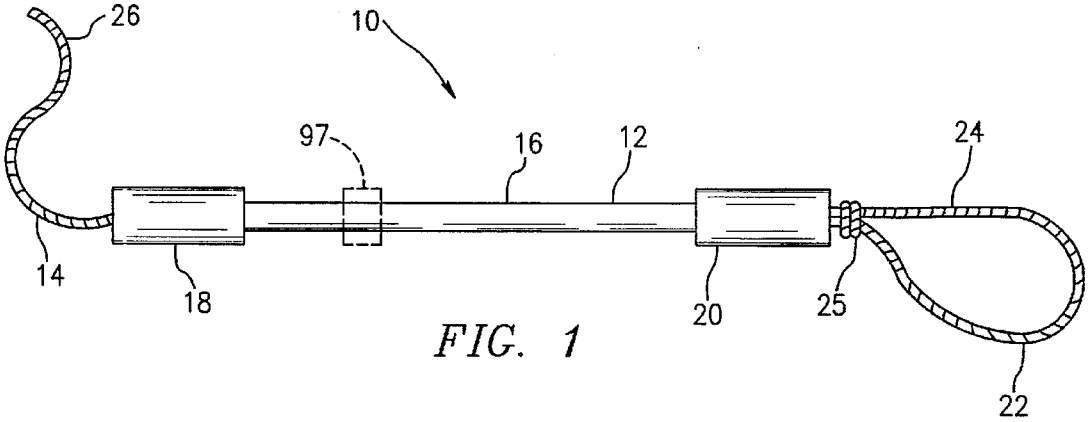
FIG. 1 is an elevational side view of the watercraft mooring apparatus of this invention.

A mooring apparatus according to this invention is composed of three principal parts: an elongate, generally tubular element, a pair of resilient cylindrical fender components attached at each end of the tubular element, and a standard marine line that extends through both the tubular element and the attached fender components. The tubular element comprises a rugged, durable and yet fairly lightweight material such as fiberglass or PVC. The fender components are typically composed of a material that is somewhat more resilient than the tubular element. Vinyl is preferred, although various other types of natural and synthetic elastomeric materials may be utilized. Any durable and strong variety of marine rope may be employed for the line.

Preferably, the tubular element has a circular cross sectional shape. However, in alternative embodiments, the tubular element may have other non-circular cross sectional shapes (e.g. elliptical, polygonal, etc.) A perfectly circular tubular element is preferred because such a piece is normally easier and less expensive to manufacture. Likewise, the fender components have cylindrical shapes featuring a circular cross section. In alternative embodiments, these components also may be non-circular in cross section. The tubular element may include a single piece or multiple tubular pieces that are secured together by appropriate means such as cylindrical coupling elements. Multiple piece versions may be disconnected to store and/or transport the apparatus when it is not in use.

The mooring apparatus is designed to prevent injurious collisions between a moored watercraft and the structure (i.e. a dock or another vessel) to which it is secured. As used herein "boats", "watercraft" and "vessels" are used interchangeably and refer to all varieties of boats, rafts or other water borne vehicles.

Several features are employed to improve the strength and shock absorbency of the mooring apparatus and, therefore, its performance in reducing damaging impacts. For example, a generally annular end plug may be fitted into each end of the tubular element. This end plug absorbs the longitudinal impact forces applied to the apparatus as the moored boat is pushed toward the dock or other watercraft. This helps to reduce splitting of and damage to the tubular element. Without the end plugs, the ends of the tubular element have a tendency to split. The tubular element itself should be strong enough to withstand at least moderate impact forces.

Each resilient fender component typically comprises two sections that are unitarily joined. The first section overlaps a respective end of the tubular element and is in a close tolerance fit with the tubular element. A second section of the fender component abuts a respective end plug and extends from a respective end of the tubular element. The opening of the fender component includes a first, relatively wide portion that extends through the first section of the fender component. This portion of the opening accommodates the tubular element and the end plug. A second, relatively narrow portion of the fender opening is communicably connected to the first opening portion and extends through the second section of the fender component. The narrow opening portion communicates with a central opening in the end plug and an axial channel in the tubular element. This permits the marine line to be disposed completely through the tubular element and the attached fender components.

The resilient second sections of the fender components act as fenders or bumpers to reduce the shock or impact forces that are transmitted along the mooring apparatus when the moored boat is tossed toward the dock or other vessel to which it is moored. Each fender component may employ either a relatively long or relatively short second section. The shock absorbing capacity of the mooring apparatus is adjusted accordingly. By featuring a longer second section, greater shock absorption is achieved. A shorter second section will exhibit less shock absorbency. Greater protection is required for large vessels, whereas less shock absorption is needed for rafts and smaller boats. Shock absorption may also be adjusted by altering the composition and resiliency of the fender component. Changing the elasticity and composition of the fender component can also affect the durability and effective life of that part. The fender components may be feature a solid construction between the opening and the outer surface. Alternatively, each fender component may employ resilient inner and outer walls and a generally hollow construction between the walls. This enables the apparatus to provide air cushioning against impacts. The air content of each fender may be controlled through an appropriate valve. In certain embodiments, the fender components may be composed of a flexible, ribbed, hose-like material. The fender components are manufactured by various known techniques such as injection molding.

The marine line is run through the tubular element and fender component. One end portion of the line is engaged with the boat to be moored and the other end portion is tied to either another boat or a dock in any acceptable manner. In some embodiments, a permanent loop and knot are formed at one end of the line. This loop is quickly and conveniently engaged with a cleat or other fastening structure on the boat to be moored. The other end of the line may also include a loop or may simply be left untied. When required, the second end is secured in any acceptable manner, to a piling, cleat, or other structure.

The dimensions of the parts used in the mooring apparatus are not critical and may be varied for particular applications. However, it has been discovered that the following dimensions work particularly well in most situations:

| | |
|---|---|
| Length of Tubular Element-Attached Fender Components- | 4 Feet |
| Diameter of Tubular Element- | 1.25 inches |
| Length of Each Fender Component- | 12 inches |
| Length of Second Section of Each Fender Component- | 2.5 inches |

The mooring apparatus effectively secures a boat to either a dock or another vessel. At the same time, the moored boat is spaced safely apart from the dock or other vessel. The tubular element and attached fender components cushion the impact forces generated by these objects. Damaging and expensive collisions are avoided in all types of rough seas, including those caused by winds, mild storms and boat wakes. The mooring apparatus moves with the secured boat as the tide rises or drops and continues to hold the boat safely away from the dock or other boat to which it is moored. By employing an apparatus of the above-described dimensions, it has been determined that the moored vessel is protected even in tides of up to 4 feet.

There is shown in FIG. I a mooring apparatus 10, which includes an elongate spacing device 12. A flexible marine line 14 is received through and interengaged with device 12 in a manner that will be described more fully below. The spacing device includes a tubular element 16 and a pair of resilient, cylindrical fender components 18 and 20 that are attached to respective ends of the tubular element in the manner described more fully below. Marine line 14 extends through and outside of spacing device 12. The line includes a looped first end portion 22 that is tied to itself at knot 25 to form loop 24. That loop preferably engages the cleat of a boat to be moored. Line 14 has an opposite free end 26 that is tied to a boat dock, cleat or other point of attachment. As a result, apparatus 10 moors a vessel to a dock or other vessel. This operation is described below in connection with FIGS. 8 and 9.

Figure 2:
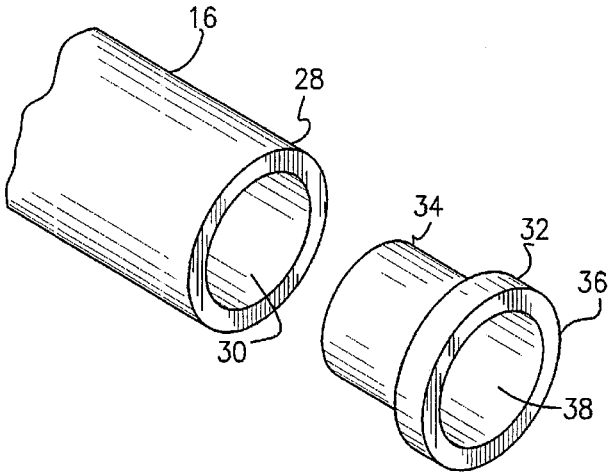
FIG. 2 is a perspective view of one end of the tubular element and an associated end plug that fits into that end.
Figure 3:
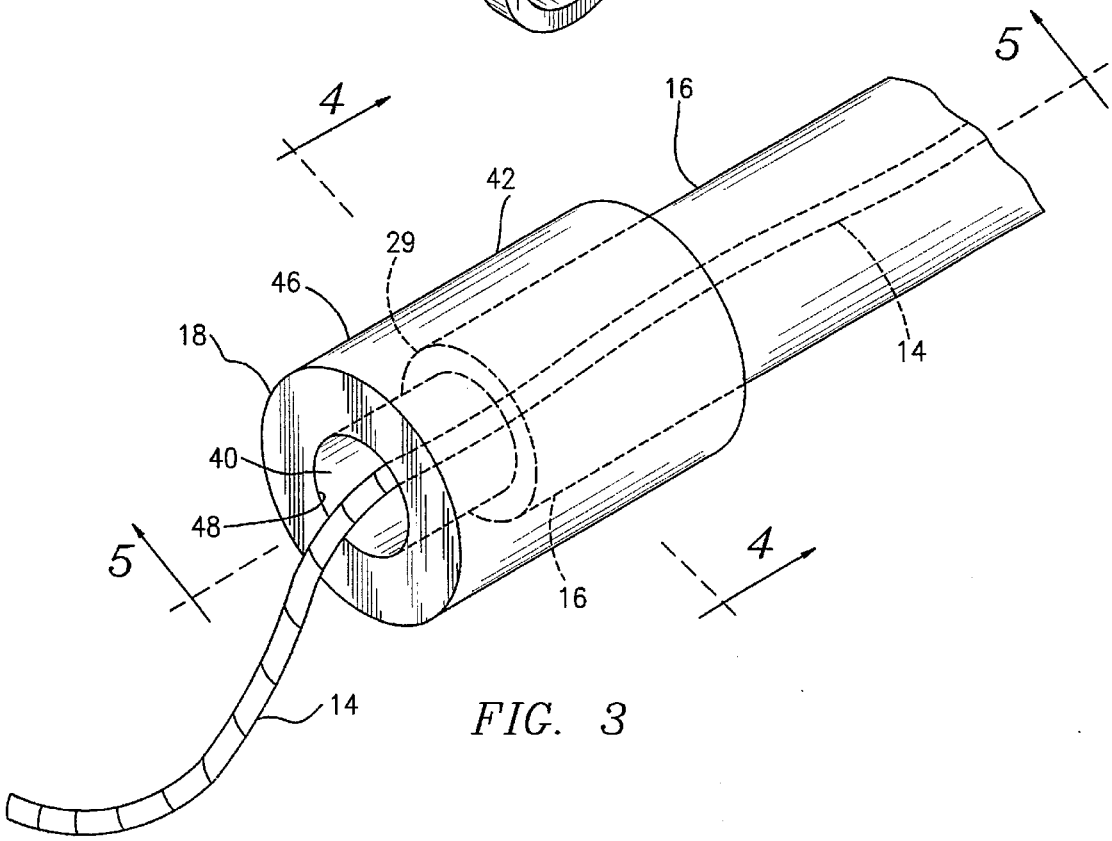
FIG. 3 is a perspective view of one end of the mooring apparatus.

FIG. 2 depicts one end 28 of tubular element 16. The opposite end 29 of the tubular element is illustrated in FIG. 3. As best shown in FIG. 2, an interior channel 30 is formed through the tubular element between the respective ends 28 and 29. A generally annular end plug 32 is received within channel 30 at each of the ends 28 and 29. Specifically, plug 32 includes a relatively narrow diameter base 34, which fits within channel 30 and interengages the inner circumferential surface of the tube. The plug also includes a cap 36 having a diameter equal to the outer diameter of tubular element 16. The cap abuts a respective end of the tubular element and serves to reinforce the tubular element against the impact forces that are transmitted through the mooring apparatus when the moored vessel is tossed toward a dock or other vessel to which it is secured. End plug 32 is typically composed of PVC, fiberglass or other material similar to that composing the tubular element. An adhesive is normally applied to the outer circumferential surface of base 34 so that the plug is permanently secured to the tubular element. A central opening 38 is formed through the plug in communication with interior channel 30 of tubular element 16. It should be noted, that a receptacle plug 38 is applied to each end of the tubular element 16. The plug located at opposite end 29 is illustrated and described more specifically in FIG. 5. As shown therein, the base 34 of each plug is substantially hollow.

In alternative versions, the tubular element may include two or more interconnected pieces. A standard cylindrical coupling component 97 (shown in phantom in FIG. 1) is used to communicably and releasably join the pieces. This version may be broken down and reassembled, as needed, for storage and transportation.

Figure 4:
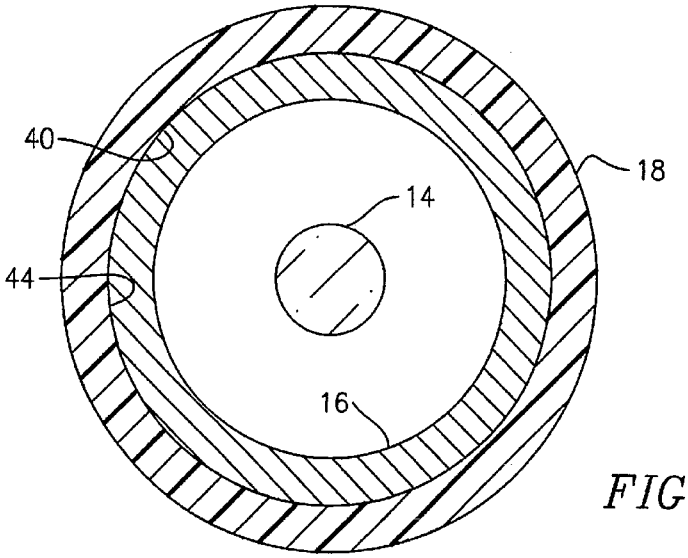
FIG. 4 is a cross sectional view taken along line 4—4 of FIG. 3.
Figure 5:
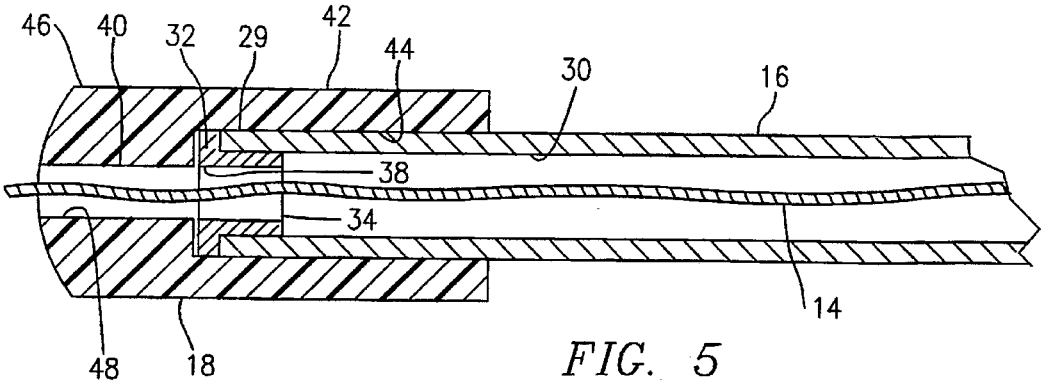
FIG. 5 is an elevational, cross sectional front view taken along line 5—5 of FIG. 3.

Fender component 18 is shown in FIGS. 3–5. It should be understood that the other fender component 20, FIG. 1, employs an identical construction and is mounted to the opposite end 28 of tubular element 16 in a similar manner. The fender components are composed of a material that is more resilient than the material composing the tubular element.

As best shown in FIGS. 3 and 4, each fender component 18, 20 has a cylindrical shape with a two-stage central opening 40 formed therethrough. As best illustrated in FIGS. 3 and 5, end 29 of tubular element 16 is received in opening 40 of fender 18. More particularly, fender component 18 includes a first section 42 that overlaps end portion 29 of element 16 and the end plug 32 attached thereto. Opening 40 includes a first, relatively wide diameter portion 44, FIGS. 4 and 5, which accommodates tubular element 16 and end plug 32. A second section 46 of the fender component is unitarily interconnected to section 42 such that sections 42 and 46 define a one-piece fender component. Second section 46 includes a narrow diameter opening portion 48, FIGS. 3 and 5. As best shown in FIG. 5, second section 46 abuts end plug 32 and extends from the end plug and from a point proximate end portion 29 of tubular element 16. This section of the fender component serves as a resilient bumper to absorb impact forces applied to apparatus 10.

Preferably, no adhesive is used between the fender components and the outside circumference of element 16. This allows the fender components to be quickly and conveniently removed from the tubular element so that either the fender components or the tubular element may be replaced when worn or damaged. Although no adhesive is employed, a relatively tight friction fit is provided so that the fender components remain securely engaged with the tubular element during use of the apparatus.

Narrow opening portion 48 extends completely through fender section 46 and communicates with wide opening portion 44. As depicted in FIG. 5, when tubular element 16 is received in wide opening portion 44 of fender 18, the wide opening portion communicates with plug opening 38 and channel 30 of tubular element 16. Line 14 extends through opening portion 48, plug opening 38, hollow plug base 34 and channel 16 of tubular element 30. See FIGS. 3, 4 and 5. The line extends fully through the tubular element and the opposite fender component 20, FIG. 1, in an manner identical to that just described. Line 14 extends from the fender components and exteriorly of spacing device 12 in the manner shown in FIG. 1.

Figure 6:
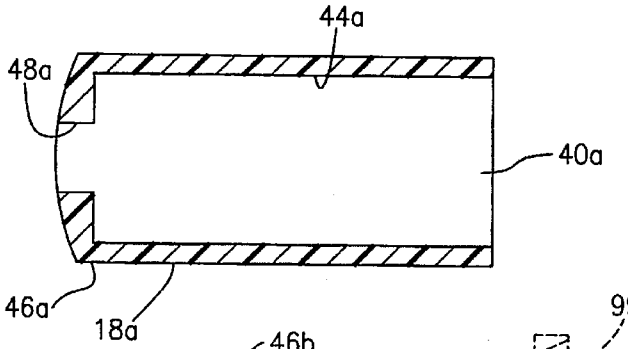
FIG. 6 is an cross sectional side view of an alternative fender component that may be employed in this invention.

An alternative fender component **18*a* is illustrated in FIG. 6. In that embodiment, the interior opening 40*a* includes a longer wide diameter portion 44*a* and a shorter narrow diameter portion 48*a*. As a result, a greater degree of overlap and interengagement between the fender component and the tubular element are achieved. This embodiment typically requires somewhat less material than in the embodiment of FIGS. 3–5. On the other hand, less shock absorption is exhibited because second fender section 46*a* is relatively narrow. This embodiment is particularly effective for protecting small vessels such as rafts against damage from collisions with docks and other vessels to which they are moored. In such cases, less shock absorption and a smaller fender section 46*a*** are required.

Figure 7:
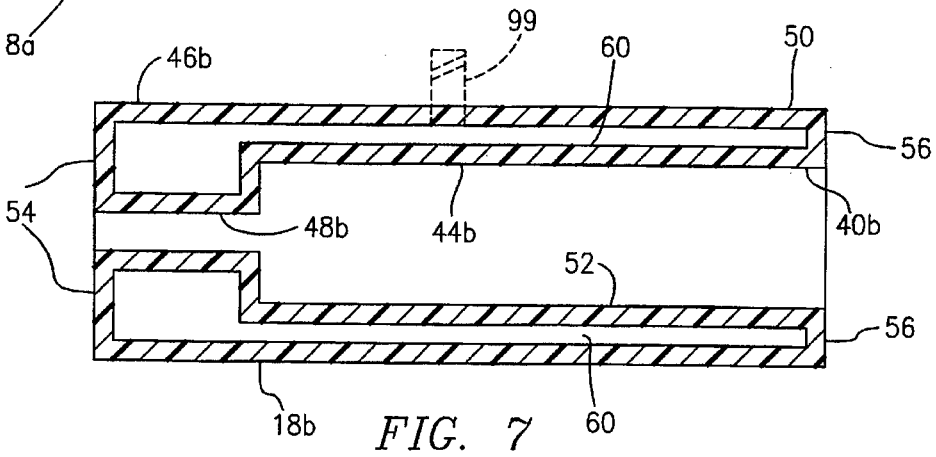
FIG. 7 is a cross sectional view of another alternative fender component.

Still another fender component **18*b* is shown in FIG. 7. Therein, the fender component employs an outer wall 50 that defines the outer circumference of the fender component. An inner wall 52 defines central opening 40*b*. Inner and outer walls 52 and 50 are interconnected by end walls 54 and 56. Again, opening 40*b* includes a relatively wide portion 44*b* and a relatively narrow portion 48*b*. Portion 44*b* receives the tubular element and portion 48*b* is formed through a second section 46*b*. This section defines the shock absorbing portion of the fender component. In this embodiment, a hollow annular interstitial space 60 is formed between outer and inner walls 50 and 52. As a result, the fender component features a relatively hollow construction, in contrast to the solid fender construction utilized in the previous embodiments. Again, various resilient materials may be employed for the fender components. The air pressure may be adjusted within the fender through a standard air valve 99**, shown in phantom. Because a hollow construction is utilized, greater resiliency and air cushioning are typically exhibited. In some cases, this may provide greater shock absorption and protection to the boat(s) and/or dock than are provided by a solid fender construction. The material of the fender components may be varied and adjusted to achieve the shock absorption characteristics required for particular applications. Such applications may differ because of the environmental, weather and sea conditions that the user expects to encounter. The sizes and types of docks and vessels involved are also factors to be considered in selecting an appropriate fender construction and composition.

Apparatus 10 is constructed by first installing the end plugs 32 into the ends of the tubular element 16. The fender components 18, 20 are then slid onto the ends of the tubular element such that they abut the respective end plugs. Finally, the marine line 14 is inserted through the fender component openings 40, the end plug openings 38 and the tubular channel 30 such that the ends of the line extend exteriorly from the fender components. The apparatus is therefore relatively easy and inexpensive to assemble.

Figure 8:
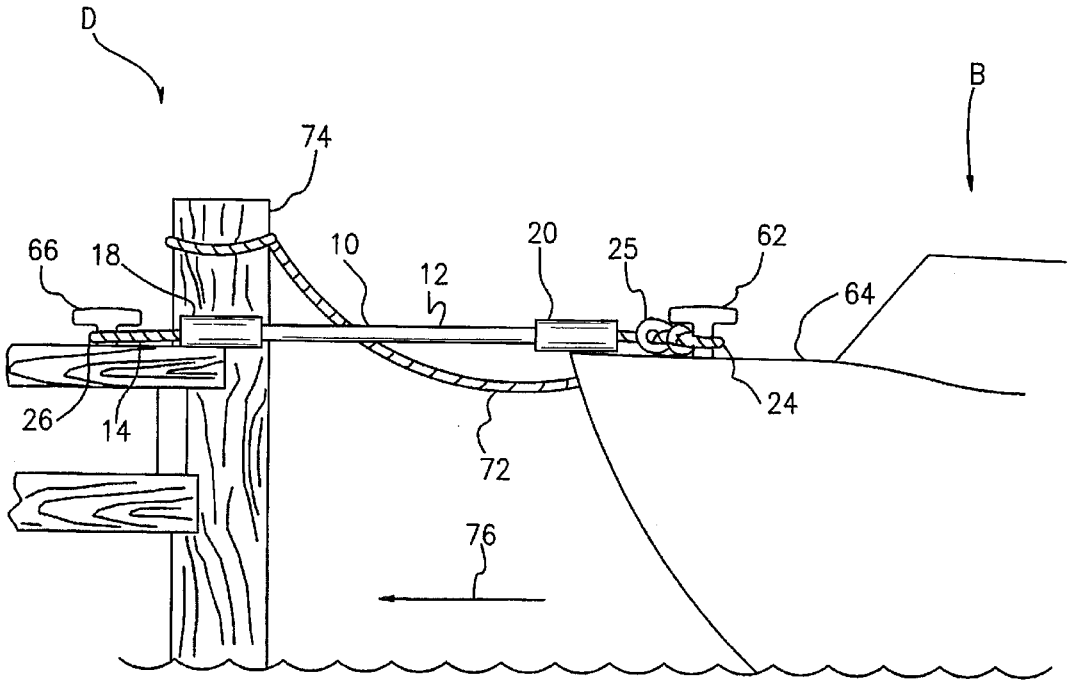
FIG. 8 is an elevational view of the mooring apparatus being used to secure a boat to a dock.

Apparatus 10 is shown in operation in FIG. 8. Therein, the mooring apparatus is used to secure a boat B to a dock D. The boat has a cleat 62 that is permanently mounted on the deck 64 of the vessel. A second cleat 66 is permanently secured to dock D. Apparatus 10 is interconnected between cleats 62 and 66 such that boat B is moored to dock D. In particular, the boater initially approaches the dock and secures a mooring line 72 to a piling 74 or some other structure associated with the dock. This provisionally secures the watercraft to the dock so that apparatus 10 may be installed. Next, the boater secures one end of mooring apparatus 10 to boat cleat 62. Loop 24 is engaged with cleat 62 and apparatus 10 is extended toward the dock. The boater stands on the dock and ties end portion 26 of line 14 to dock cleat 66 in a standard manner. As a result, apparatus 10 is securely interengaged between cleats 62 and 66. Subsequently, when rough seas are encountered and boat B is pushed toward dock D, apparatus 10 holds the boat safely away from the dock so that damaging collisions are avoided. Specifically, when boat B is pushed toward dock D, in the direction of arrow 76, spacing device 12 causes the boat to maintain a predetermined distance from the dock. This distance may be adjusted by varying the length of the spacing device that is used. As the boat rocks, pitches and drifts, fender 18 cushions the impact of spacing device 12 against dock D and dock cleat 66. Fender component 20 similarly cushions the impact of the other end of the spacing device against boat B and boat cleat 62. Meanwhile, marine line 14 remains interconnected between cleats 62 and 66 so that boat B is securely moored to the dock.

It should be noted that line 14 may be interconnected between various parts of the dock and/or boat other than those depicted. For example, end portion 26 of line 14 may be secured to piling 74 or to the planks of the dock. Similarly, loop 24 may be attached to other portions of boat B. In all such embodiments, the benefits of this invention are achieved. In particular, appropriate spacing between the boat and the dock is maintained and those objects remain securely interconnected. Additionally, the fender components absorb impact forces and reduce damage to the boat and the dock as the boat is pushed toward the dock. Although a single mooring apparatus 10 is illustrated in FIG. 8, it should be understood that two or more such devices may be used in a typical docking situation. Preferably, one mooring apparatus 10 is interconnected between the bow of the boat and the dock and a second mooring apparatus is similarly interconnected between the dock and the bow of the boat. In this manner, the entire length of the boat is held safely and securely apart from the dock.

In FIG. 8A a pair of mooring apparatuses 10 are secured between boat B1 and dock D1. The mooring apparatuses are fastened to conventional cletes 140, 142 and 144, 146 on the boat and dock, respectively. Criss-crossed spring lines 150 and 151 are also secured between boat B1 and dock D1. Spring line 150 extends between forward boat clete 140 and dock clete 144. Spring line 151 similarly extends between aft boat clete 142 and dock clete 146. Alternatively, spring lines 152 and 154, shown in phantom, may be used. Spring line 152 extends between boat clete 140 and dock clete 156. Spring line 154 extends from boat clete 142 to dock clete 158. Other spring line configurations may also be employed. In all cases, the spring lines prevent the boat from drifting fore and aft relative to the dock. Use of spring line connections is required for the mooring apparatuses to operate effectively. By using a pair of spring lines in conjunction with mooring apparatuses 10, as shown in FIG. 9A, the boat may be drawn safely and gently against the dock for passenger boarding and departure. This is accomplished by simply releasing one of the spring lines in either version. As a result, boat B1 gradually drifts aft (if either spring line 150 or line 151 is released) or forward (if either spring line 150 or 154 is released.) As the same time, mooring apparatuses 10 pivot more or less in unison, while remaining substantially parallel to one another. This pulls the boat up against the dock so that convenient access is achieved.

Figure 9:
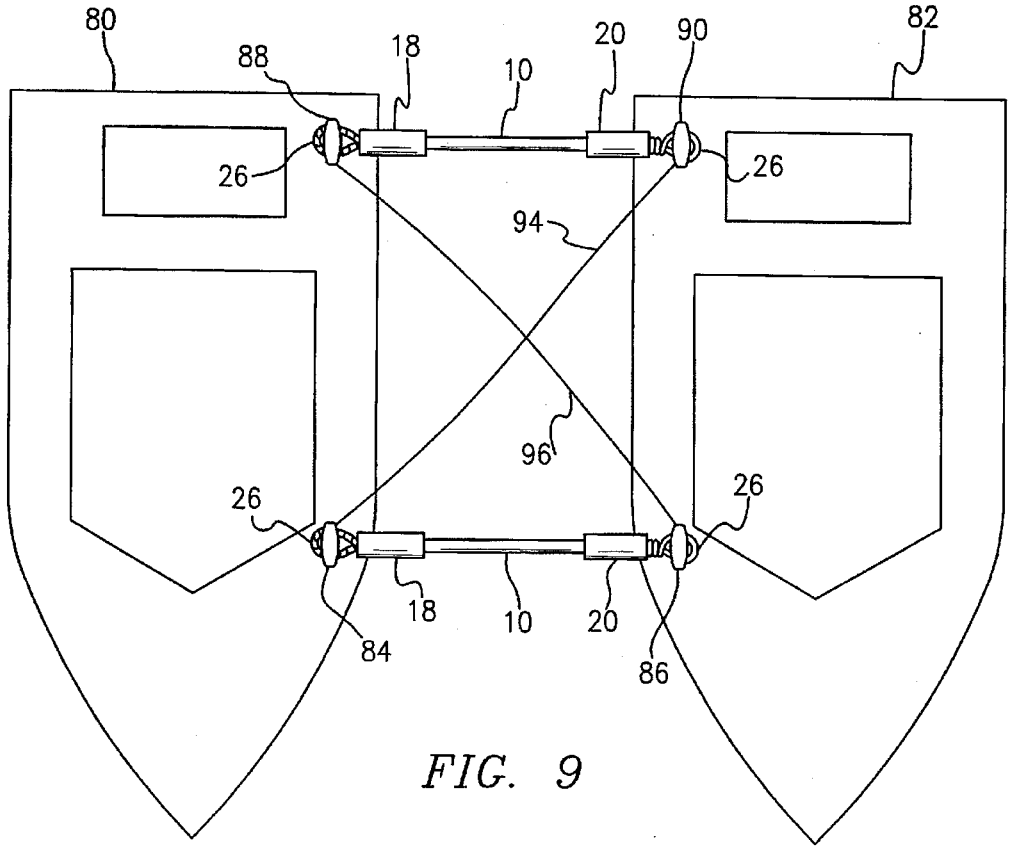
FIG. 9 is an overhead view of a pair of mooring apparatuses being used to interconnect and hold apart a pair of adjacent vessels.

There is shown in FIG. 9 a pair of vessels 80 and 82 joined together by two mooring apparatuses 10 according to this invention. A forward mooring apparatus is interconnected between respective forward cleats 84 and 86 of boats 80 and 82. Similarly, a rearward mooring apparatus is interconnected between aft cleats 88 and 90. Loop 24 of forward mooring apparatus 10 engages cleat 26 and free end 26 of the forward apparatus is tied to cleat 84. Loop 26 of rearward apparatus 10 is engaged with cleat 90 and free end 26 of the rearward mooring apparatus is tied to cleat 88.

In the embodiment of FIG. 9, the mooring apparatuses are used in conjunction with conventional criss-crossed spring lines 94 and 96. Spring line 94 is interconnected between forward cleat 84 of boat 80 and rearward cleat 90 of boat 82. Similarly, spring line 96 is interconnected between forward cleat 86 of boat 82 and rearward cleat 88 of boat 80. These spring lines prevent boats 80 and 82 from shifting longitudinally in position. As a result, mooring apparatuses 10 are maintained generally parallel to one another so that boats 80 and 82 are held safely and securely apart. Once again, the fender components 18 and 20 absorb the impact forces transmitted between the mooring apparatuses and the interconnected boats. Damage to the boats is thereby avoided.

Although line 14 is described herein as having a loop 24 at one end and a free opposite end, this may be varied in other embodiments. For example, a relatively permanent loop may be formed at both ends of the apparatus. Alternatively, a free, untied end portion may be utilized at each end of the line. This allows the user complete flexibility in attaching the mooring apparatus to available structure so that secure interengagement is achieved.

In FIG. 10 an alternative apparatus **10*a* is secured to an eyelet 110 of a personal watercraft 112. Loop 24 extends through openings 114 and 116 of an elongate plastic or metal clip 118. The loop and attached clip are inserted through and interengaged with eyelet 110 such that apparatus 10*a* is secured to the eyelet. Clip 118 prevents the mooring apparatus from separating from watercraft 112 when apparatus 10*a* is pulled in the direction of arrow 120**.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A boat mooring apparatus comprising:

an elongate spacing device that includes a generally tubular element having an interior channel formed therethrough and a pair of resilient, one-piece fender components attached to respective ends of said tubular element, each fender component extending longitudinally beyond and radially overlapping a respective end of said tubular element and having a respective opening formed centrally therethrough, each said opening being in communication with said interior channel, each said fender component being more resilient than said tubular element; and a flexible line that extends through said interior channel and said openings and outside of said spacing device, said line having a first end portion, which includes first means for releasably engaging a first boat, and an opposite second end portion, which includes second means for releasably engaging one of a second boat and a dock, whereby the first boat is selectively moored to one of the second boat and the dock.

2. The apparatus of claim 1 in which each end of said tubular element receives a respective, generally annular plus that reinforces said end.

3. The apparatus of claim 1 in which each fender component is more resilient than said tubular element.

4. The apparatus of claim 1 in which said ends of said tubular element are received in respective openings of said fender components.

5. The apparatus of claim 4 in which each fender component includes a first section that overlaps and is in close tolerance interengagement with said tubular element and a second section that extends from a point proximate a respective said end of said tubular element.

6. The apparatus of claim 5 in which each said opening includes a first, relatively wide portion that extends through said first section of said fender component and accommodates said tubular element, and a second, relatively narrow portion that is communicably connected to said first portion and extends through said second section of said fender component.

7. The apparatus of claim 1 in which said first means for releasably engaging includes a loop formed proximate said first end of said line.

8. The apparatus of claim 1 in which said second means for releasably engaging includes a line segment proximate said second end of said line, said line segment being selectively tied to one of said second boat and said dock.

9. The apparatus of claim 4 in which each end of said tubular element receives a respective generally annular end plug that reinforces said end of said tubular element, each said fender component including a first section that overlaps and is in close tolerance interengagement with said tubular element and a respective said end plug, and a second section that extends from and abuts a respective said end plug.

10. The apparatus of claim 1 in which at least one fender component includes an inner wall that defines said opening, an outer wall and a hollow space formed between said inner and outer walls.

11. The apparatus of claim 7 in which said loop carries an elongate clip, said loop and said clip being insertable to and interengageable with an eyelet carried by a vessel to secure the apparatus to the vessel.

12. The apparatus of claim 1 in which each said opening has a diameter that is no greater than the diameter of said channel.

13. The apparatus of claim 1 in which the spacing device has a length of approximately 48".

14. The apparatus of claim 5 in which each said second section of said fender component extends approximately 2.5 inches beyond the corresponding end of said tubular element.

15. The apparatus of claim 1 in which said tubular element includes at least two tubular segments and means for releasably interconnecting said segments in an axially aligned manner.

16. The apparatus of claim 1 further including a pair of spring lines separate and distinct from said flexible line, each said spring line being interconnected between the first boat and one of the second boat and the dock.

17. The apparatus of claim 16 in which said spring lines have a criss-crossed configuration.

18. The apparatus of claim 1 in which said flexible line passes through said tubular element in a single run.

19. The apparatus of claim 1 in which said flexible line includes a knot located between one end of said line and said spacing device.

* * * * *